United States Patent [19]

Gilbert et al.

[11] Patent Number: 4,508,387

[45] Date of Patent: Apr. 2, 1985

[54] LEG AND FOOT SUPPORT ASSEMBLY FOR MEDICAL EXAMINATION TABLE

[75] Inventors: Wilbur E. Gilbert; Robert E. Martin; Donald P. Belonger, all of Two Rivers, Wis.

[73] Assignee: Hamilton Industries, Inc., Two Rivers, Wis.

[21] Appl. No.: 537,341

[22] Filed: Sep. 29, 1983

[51] Int. Cl.[3] ..... A47C 7/50

[52] U.S. Cl. ..... 297/429; 297/433; 297/435; 297/437

[58] Field of Search ..... 297/429, 431, 433, 434, 297/435, 436, 437

[56] References Cited

U.S. PATENT DOCUMENTS

| | | | |
|---|---|---|---|
| 508,690 | 11/1893 | Fauber | 297/433 X |
| 520,579 | 5/1894 | Shackelford et al. | 297/433 X |
| 2,558,143 | 6/1951 | Lauterbach | 297/437 X |
| 2,604,140 | 7/1952 | Bursey | 297/429 X |
| 3,858,938 | 1/1975 | Kristensson et al. | 297/429 |

*Primary Examiner*—Francis K. Zugel
*Assistant Examiner*—Peter R. Brown
*Attorney, Agent, or Firm*—Tilton, Fallon, Lungmus

[57] ABSTRACT

A medical examination table having a leg and foot support assembly that may be pivoted between a raised position, where it is generally coplanar with the seat section of the table, and any of a variety of lowered positions. The assembly includes a frame pivotally connected to the seat section and a footrest extension which is capable not only of being extended and retracted in the general plane of the frame but also of being pivoted into foot-supporting positions disposed at substantially right angles to the frame. Such adjustments are accomplished without the need for attaching or detaching any components of the assembly. Should the assembly be in a generally vertical position and engage an obstruction as the table is lowered (as where the table is equipped with a power drive for raising and lowering), the support assembly will retract automatically to avoid injury that might otherwise result.

35 Claims, 15 Drawing Figures

LEG AND FOOT SUPPORT ASSEMBLY FOR MEDICAL EXAMINATION TABLE

BACKGROUND

Retractable footrests for various types of chairs and examination tables are well known in the art but such structures are usually incapable of the wide variety of adjustments necessary for medical usage, are often difficult or time consuming to adjust properly, and sometimes require the detachment or attachment of components or accessories to achieve the desired condition for a selected medical procedure. The result, in general, is that if adequate adjustment is even possible, such adjustment cannot always be performed quickly and without attaching or detaching various components. Such shortcomings may have serious consequences in medical procedures where speed and reliability are generally considered essential.

U.S. Pat. No. 4,168,099 discloses a multi-position power-operated examination chair with leg-supporting cradle elements but without associated footrest structures. Other patents disclosing chairs and tables equipped with legrests and/or footrests, whether for medical or non-medical use, are U.S. Pat. Nos. 3,100,129, 3,869,169, 3,151,910, and 9,960.

SUMMARY OF THE INVENTION

The leg and foot supporting assembly of this invention is particularly suitable for use as part of a power-operated medical examination table capable of being raised and lowered electrically or hydraulically, and preferably one that also has power means for pivoting the leg and foot support assembly between a raised position in which that assembly is generally coplanar with the seat section of the table (as commonly required during basic patient examination, colonoscopic examination, endoscopic examination, pediatric examination, Trendelenburg and reverse Trendelenburg orientation, etc.), and a lowered position in which the support assembly extends downwardly at generally right angles to the seat section (as may be required for gynecological examination, urological procedures, proctoscopic examination, etc.). Such an assembly may also be power operated into any of an infinite number of partially lowered positions to suit the requirements of a medical procedure or to meet the needs or preferences of the patient.

The leg and foot support assembly is composed of two main parts that may be horizontally extended and retracted to provide proper support for patients of different sizes and shapes. Such adjustment may be easily and quickly accomplished manually without tools and without adding or removing one or more related components. When the assembly is swung into a lowered position, one of the parts of that assembly, termed a footrest extension, may be pivoted into a position at generally right angles to the other part and shifted into any of a variety of selected elevations to provide an effective footrest for the patient. Again, such adjustments may be easily and quickly performed without tools and without adding (or removing) components, adjusting levers or handles, removing or connecting springs or pins, or manipulating any small parts that might become jammed or detached.

A feature of particular importance in view of the power operation of the table/chair is the ability of the leg and foot support assembly to collapse or retract automatically should the assembly engage an obstruction as the table/chair as a whole is being power driven into a lowered position. Such automatic retraction avoids or at least minimizes the damage that might be caused to other medical equipment and furniture engaged by the leg support assembly as the power-driven table descends, and could prevent serious injury to a doctor, nurse, or assistant who happens to have a foot, limb, or other body part in the way of the support assembly during such a lowering operation.

Since there are no handles or levers requiring manipulation when the leg and foot support assembly is to be adjusted and set at a selected position, both hands may be used to grasp the assembly and carry out the action needed for proper adjustment. Such adjustments may be easily made by one person with a minimum of effort and time.

Briefly, the leg and foot support assembly includes a frame which is hingedly connected at its proximal end to the seat section of an examination table/chair for power-operated movement between raised and lowered positions. The frame includes at least one vertical and longitudinally-extending wall, and preferably a pair of such walls in the form of spaced parallel side walls, having first and second longitudinal guide rails that define an elongated guide slot between them. The second main component of the assembly, the footrest extension, has an elongated side member that extends along each such longitudinal wall of the frame. Each side member of the footrest extension has a pair of bearing elements adjacent the proximal end thereof, one of the elements being slidably retained in the guide slot for both slidable and pivotal engagement with the inwardly facing longitudinal surfaces of the rails defining that slot. The other bearing element of each side member is slidably engagable with the outwardly facing surfaces of the guide rails. Stop means closes off the guide slot at its proximal end, thereby limiting sliding movement of the one bearing element in a proximal direction while at the same time permitting pivotal movement of the footrest extension for the purpose of shifting the second bearing element from sliding engagement with the outwardly facing surface of one of the guide rails into sliding engagement with the outwardly facing surface of the other guide rail. Therefore, when the frame of the assembly is in a lowered (vertical) or partially lowered position, an operator may simply grasp the footrest extension, slide it into a raised position in which the bearing element confined within each slot is at the upper or proximal end of that slot, and then pivot the footrest extension into a forwardly and upwardly angled position. With the footrest extension so oriented, that extension may be lowered into any of a multiplicity of positions along the length of the guide slot and then set in place by allowing the front or distal end to swing downwardly until the footrest extension is generally perpendicular in the frame. Should the forwardly-projecting footrest extension later engage an obstacle as the chair is being lowered, the footrest extension will simply pivot upwardly to accommodate the obstruction. On the other hand, should the footrest extension and frame be vertically aligned and fully extended, and should the footrest extension then engage an obstruction (for example, the foot of an operator standing in close proximity to the chair) as the chair or table descends, the footrest extension will automatically retract in a generally vertical plane.

Other features, objects, and advantages of the invention will become apparent from the specification and drawings.

DRAWINGS

Figure 5:
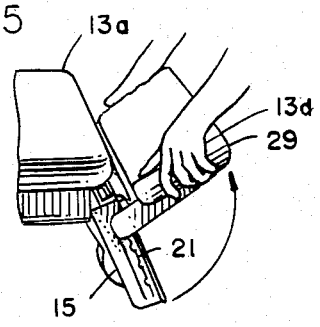

FIG. 5 fragmentary perspective view showing the frame of the support assembly in a partially lowered condition and depicting the procedure for adjusting the footrest extension into an operative forwardly-projecting position.

Figure 6:
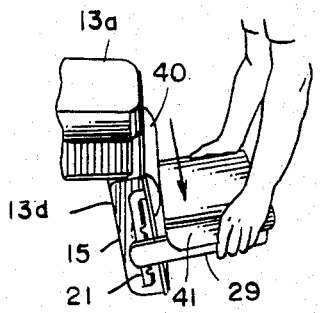

FIG. 6 is a fragmentary perspective view similar to FIG. 5 but showing a final stage in the adjustment of the footrest extension.

Figure 7:
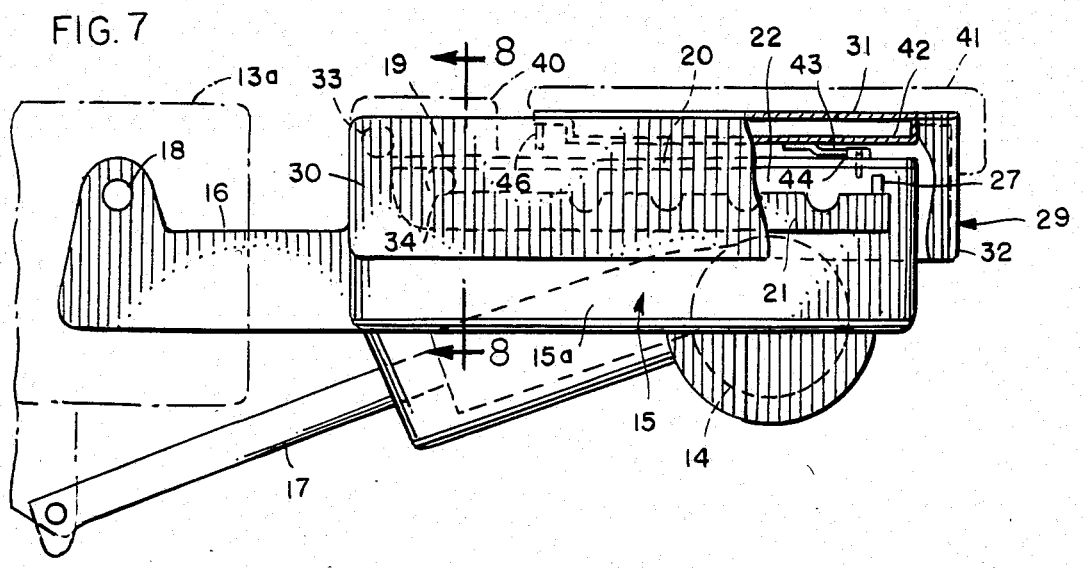

FIG. 7 is an elevational view showing the support assembly in a raised or horizontal position, certain portions of the structure being broken away to reveal features of construction, and the cushions being depicted in phantom for clarity of illustration.

Figure 8:
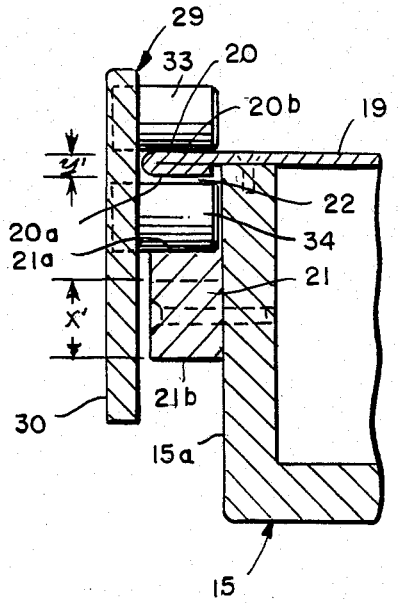

FIG. 8 is an enlarged sectional view taken along line 8—8 of FIG. 7.

Figure 9:
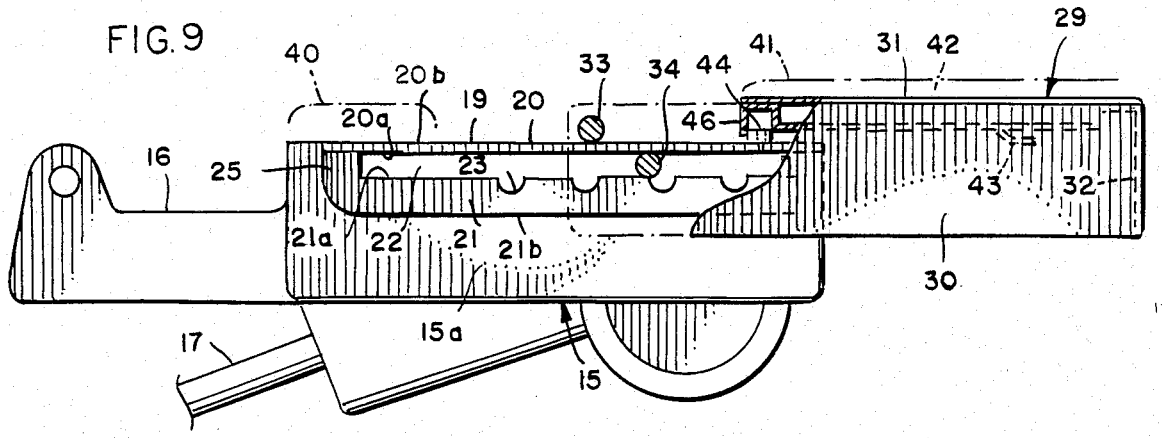

FIG. 9 is an elevational view similar to FIG. 7 but showing the footrest extension in its fully extended position.

Figure 10:
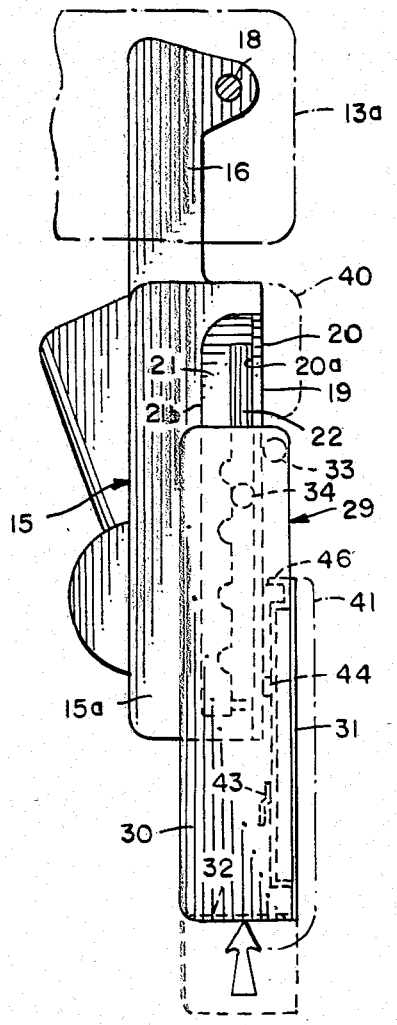

FIG. 10 is an elevational view of the support assembly in a fully lowered vertical position, the footrest extension being shown partially raised as it might appear should it engage an obstruction during lowering of the table/chair, or as it would appear during a first step in a procedure for swinging the extension into horizontal position to serve as a footrest.

Figure 11:
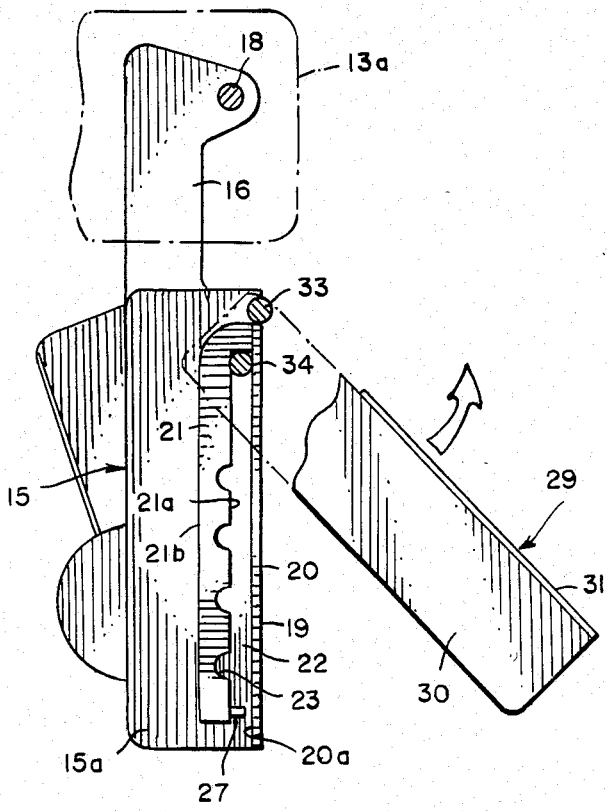

FIG. 11 is an elevational view similar to FIG. 10 but showing the footrest extension in a further stage of adjustment as it is being swung into operative position as a footrest.

Figure 12:
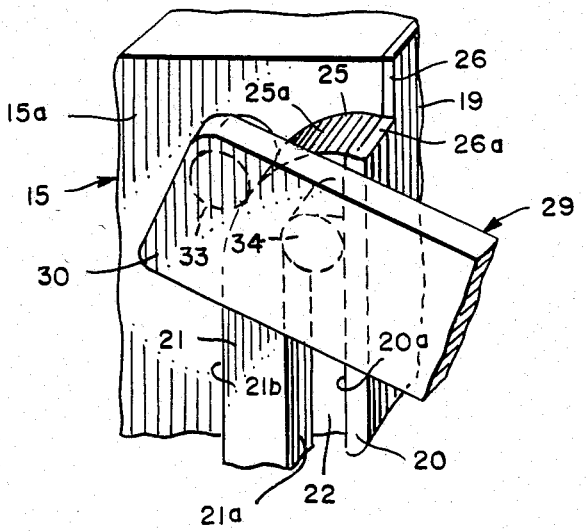

FIG. 12 is a fragmentary perspective view showing the relationship of parts during pivotal movement of the footrest extension in relation to the support frame.

Figure 13:
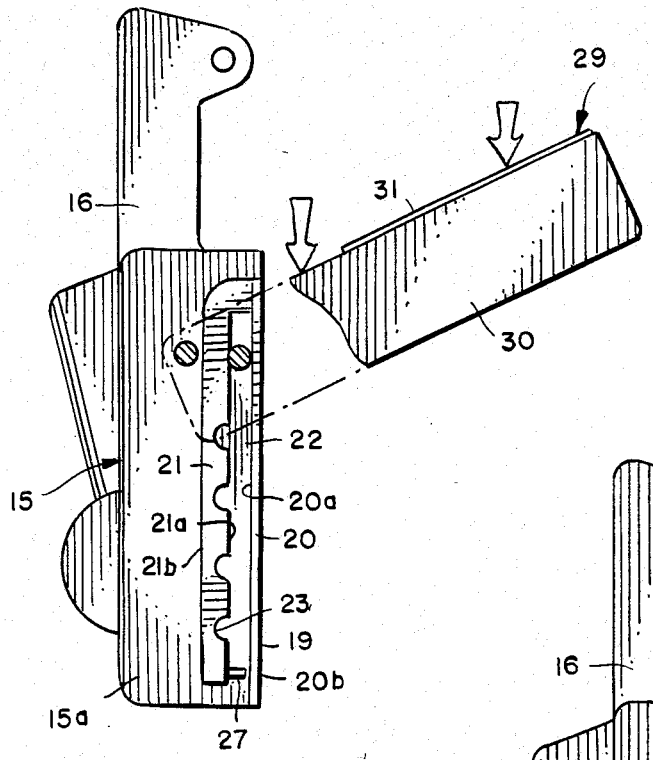

FIG. 13 is an elevational view similar to FIG. 12 but illustrating a further step in shifting the footrest extension into horizontal position.

Figure 14:
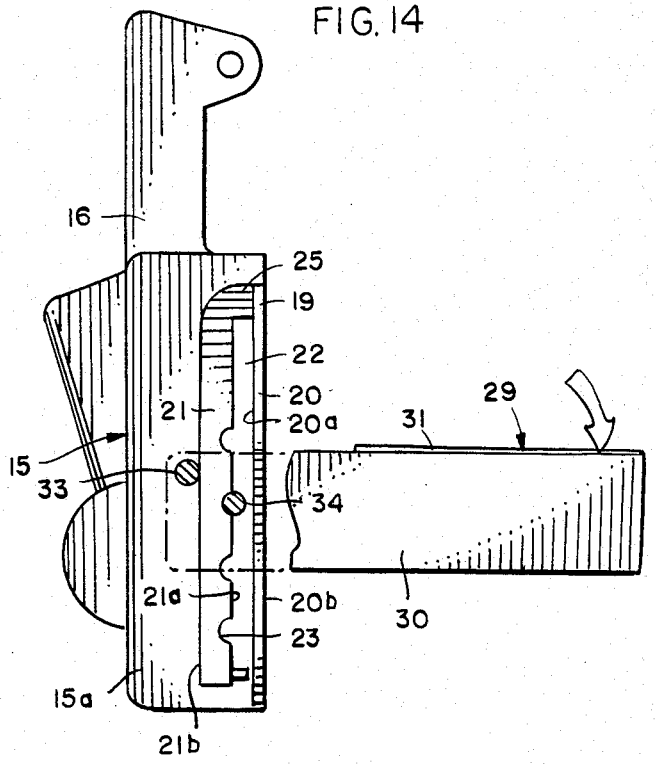

FIG. 14 depicts a final step in adjusting the extension into a horizontal footrest position.

Figure 15:
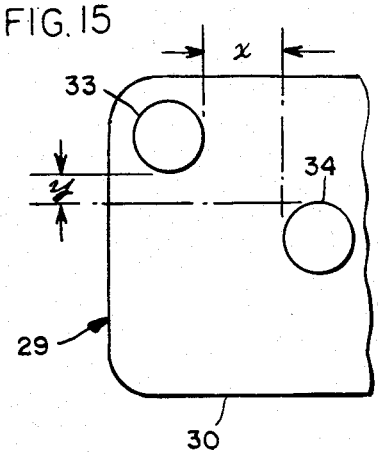

FIG. 15 is a fragmentary schematic elevational view of the proximal end of a side member of the footrest extension showing certain critical relationships thereof.

DETAILED DESCRIPTION OF PREFERRED EMBODIMENT

Figure 1:
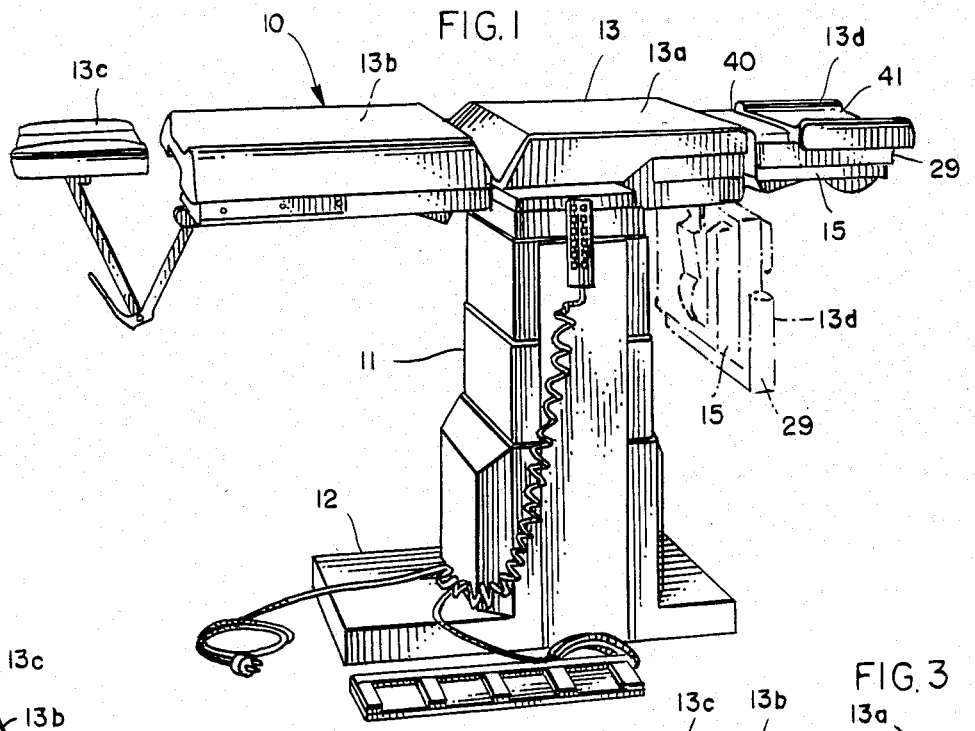
FIG. 1 is a perspective view of an examination table/chair equipped with the leg and foot support assembly of this invention.
Figure 2:
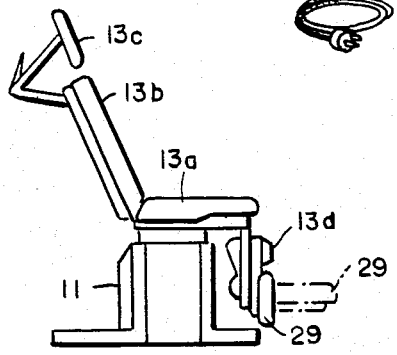
FIG. 2 is a simplified side elevational view showing the table in one position of adjustment for use as a chair.
Figure 3:
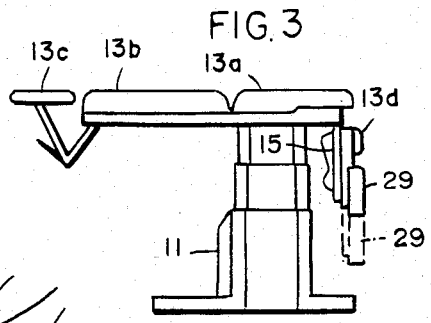
FIG. 3 is a side elevational view showing the table in elevated condition and in another position of adjustment as used, for example, for urological examination.

FIG. 1 shows a power-operated multi-position table 10 (or table/chair) of a type particularly useful for medical examinations and minor surgery. The table has a power-operated telescoping pedestal 11, a base 12, and a top 13 composed of seat section 13*a*, back section 13*b*, headrest section 13*c*, and leg and foot support section 13*d*. The telescoping pedestal 11 may be extended or retracted under power between the fully raised position shown in FIGS. 1 and 3 and a lowered position as depicted in FIG. 2. Although not shown, the seat section 13*a* (and the top 13 as a whole) may be power driven into rearwardly or forwardly tipped positions when the table is to be adjusted into Trendelenburg or reverse Trendelenburg orientation. In addition, the backrest 13 may be raised (FIG. 2) or lowered (FIGS. 1, 3), and the leg/foot support assembly 13*d* may also be raised (FIG. 1) or lowered (FIG. 3), all under power developed through electric motors and suitable transmissions concealed within the pedestal 11 and top 13. Only one such motor and its worm-drive transmission 14 are shown in the drawings (FIG. 7). It is to be understood that other types of power drives well known in the art, such as hydraulic motors or a combination of electric and hydraulic power systems, might be used. The entire structure is referred to as a "table" but it may also be properly designated as a chair since it is fully capable of being used as an examination chair when the pedestal is lowered, the backrest fully raised, and the leg/foot support assembly lowered (FIG. 2). It is also to be understood that details of the table/chair 10 are presented only for purposes of illustration and that the leg and foot support assembly with which this invention is specifically concerned might be used in conjunction with other types of power-operated multi-position tables, chairs, or table/chairs. The particular examination table/chair shown in the drawings is a Model 1K2 table, Hamilton Industries, Two Rivers, Wisconsin.

The leg and foot support assembly 13*d* has two main components: a frame 15 and a footrest extension 29. The frame is of generally rectangular box-like configuration equipped at its proximal end with a pair of support arms 16 pivotally connected to seat section 13*a* for pivotal movement between a raised or horizontal position, in which the frame is in planar alignment with the seat section 13*a* (FIGS. 1, 4, 7, 9) and a fully lowered vertical position in which the plane of the support assembly extends at right angles to the seat section (FIGS. 1 (broken lines), 2, 3, 10). The frame encases the motor 14 and its transmission, the latter being operatively connected by shaft 17 to seat section 13*a*. Retraction or extension of that shaft causes the frame to swing downwardly or upwardly about horizontal pivots 18 that hingedly connect the frame to the seat section. It is to be understood that the frame may also be pivoted into any of a variety of partially-lowered (or partially-raised) positions as indicated, for example, in FIGS. 5 and 6.

The rectangular frame 15 has a pair of side walls 15*a* extending along spaced, parallel, vertical planes. A cover 19 extends over the frame and projects laterally outwardly beyond the lateral surfaces of the side walls 15*a* to define a first pair of upper guide rails 20 extending longitudinally along opposite sides of the frame between the proximal and distal ends thereof. As illustrated in FIG. 8, the cover or top panel may have its side portions folded inwardly so that the rails 20 are of double thickness and are thereby strengthened or reinforced.

A second or lower rail 21 extends longitudinally along each side wall and is spaced beneath the first or upper rail 20 to define an elongated guide slot or channel 22 therebetween. Each lower guide rail 21 is screwed or otherwise rigidly secured to a side wall 15*a* of the frame. The guide slot 22 along each side of the frame is of uniform width (height) throughout its full extent except for a series of arcuate longitudinally-spaced notches 23 formed along the inwardly-facing surface 21*a* (i.e., the upper surface facing into guide slot 22). The second or lower guide rail 21 also provides a straight outwardly-facing guide surface 21*b;* that is, a surface that faces outwardly away from guide slot 22 (downwardly, when the support assembly is in the raised position depicted FIGS. 7–9).

The first or upper guide rail 20 is also provided with an inwardly-facing guide surface 20*a,* which faces into guide slot 22, and an outwardly-facing guide surface 20*b* which is directed away from the guide slot. Again, as shown in FIGS. 7 and 9, inwardly-facing guide surface 20*a* is directed downwardly, and outwardly-facing guide surface 20*b* is directed upwardly, when the frame 15 is in a horizontal or raised position.

As shown most clearly in FIGS. 9 and 12, the guide slot 22 is blocked off near the proximal end of the frame by an extension 25 of the second guide rail 21. Such extension serves as stop means at the proximal end of the slot and also provides an arcuate guide surface which merges smoothly with the outwardly-facing guide surface 21*b* of guide rail 21. It will also be observed that a recess or notch 26 is formed in each of the proximal corners of cover plate 19 and that one edge 26*a* of the recess is flush with arcuate guide surface 25*a*. Stop means may also be provided at the opposite (distal) end of the slot 22 in the form of stop pin or screw 27 (FIGS. 7, 11).

The second major component of the assembly, the footrest extension 29, is also generally rectangular in configuration and includes a pair of parallel side members 30, a top member or panel 31 that bridges the side members, and a front or distal member 32. The elongated side members 30 extend along the side walls 15*a* of the frame 15 in close proximity to those walls (FIG. 8). Each side member 30 is provided adjacent its proximal end with a pair of bearing elements 33 and 34 extending towards the adjacent side wall 15*a* of the frame. One of the bearing elements 34 is confined within guide slot 22 for longitudinal movement along that slot and also for pivotal movement within certain constraints imposed by other elements of the assembly. Bearing element 34 may be solid or may take the form of a roller assembly; in the embodiment illustrated, the bearing element is in the form of a generally cylindrical pin or peg that is welded or otherwise rigidly secured to side member 30 intermediate the upper and lower longitudinal edges thereof.

Bearing element 33 is of the same construction as element 34 and is parallel to the first element. It will be noted from the drawings, however, that bearing element 33 is spaced both proximally and transversely (vertically, when elongated member is horizontally oriented) from bearing element 34. The spacing is important and is related to the thicknesses of the guide rails 20 and 21 as well as the guide slot 22 extending therebetween. Specifically, the diameter of bearing element 34 should be slightly less than the width of guide slot 22 for the purpose of facilitating sliding movement of the bearing element along that slot and also to permit slight pivotal movement of the footrest extension 29 in relation to frame 19 regardless of the position of adjustment of the footrest extension, as will be described in greater detail hereinafter. The longitudinal spacing x between bearing elements 33 and 34 should closely approximate the thickness x′ of the second guide rail 21 (FIGS. 8 and 15); where the guide rail is provided with notches 23 as shown, then the thickness of that rail should be measured from the depth of each notch 23 to the outwardly-facing bearing surface 21*b* (FIG. 8). The transverse spacing y between bearing elements 33 and 34 should approximate, but slightly exceed, the thickness y′ of the first or upper guide rail 20 (FIGS. 8, 15).

Referring to FIGS. 7 and 9, top panel 31 extends to the distal end of the footrest extension but terminates well short of the proximal end thereof. Stated differently, the side members 30 extend proximally beyond the proximal end of top panel 31. A first cushion 40 is fixed to the proximal end of the frame and, when the footrest extension is in its retracted condition (FIGS. 7, 1), occupies most of the surface of cover plate 19 proximal to the top panel 31 of the footrest extension. The footrest extension 29 is provided with its own cushion 41 which is substantially larger than cushion 40, covering the entire top panel 31 and, preferably, extending a limited distance alongside side members 30 and front member 32.

Figure 4:
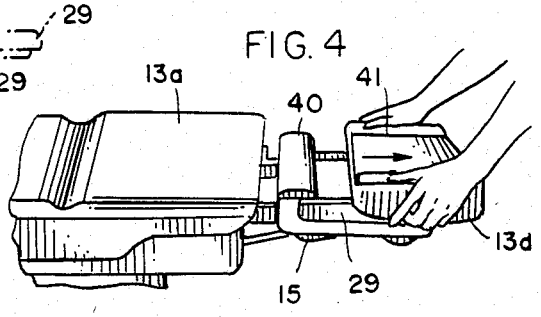
FIG. 4 is a fragmentary perspective view illustrating the leg and foot support assembly in raised position and showing the procedure for horizontally extending that assembly.

The underside of the cover panel 31 of footrest extension 29 has a reinforcing inner shell 42 shown most clearly in FIGS. 7 and 9. A latching member or tongue 43 projects downwardly from the underside of the shell and is engagable with a stop member or block 44 secured to the cover plate 19 of frame 15 when the footrest extension 29 is retracted (FIG. 7). Because of the size differential between the diameter of lower (second) bearing element 34 and the distance between inwardly-facing guide surfaces 20*a* and 21*a* (FIG. 8), the distal or front end of the footrest extension 29 may be lifted or pivoted upwardly just far enough for tongue 43 to clear block 44, thereby permitting the footrest extension to be pulled horizontally outwardly as depicted in FIG. 4. When the footrest extension has reached the forward or distal limits of its travel, the stop block 44 is engaged by a depending flange 46 along the distal (rear) edge of top panel 31 (FIG. 9). Therefore, FIGS. 7 and 9 show the footrest extension at the limits of its travel in a longitudinal direction along support frame 15.

For general examination, or for Trendelenburg or reverse Trendelenburg orientation of a patient, the leg and foot support assembly 13*d* would be elevated into the raised position shown in FIGS. 1, 7, and 9, and the footrest extension would be shifted forwardly or rearwardly to meet the requirements of the medical procedure and to provide proper support for the patient. For other types of examinations and chair positions, assembly 13*d* would be pivoted under power into a partially or fully lowered position. When the assembly is fully lowered (FIG. 10), the footrest extension is still capable of being slid upwardly and downwardly within the limits provided by the guide rails 20 and 21, guide slot 22, and stop means 25 and 44. Should the footrest extension 29 be fully extended downwardly as shown in broken lines in FIGS. 3 and 10, and should the footrest extension then engage an obstruction as the table 10 is driven downwardly under power into a lowered position, the footrest extension 29, upon engaging such obstruction, will simply slide into a retracted position as the table top continues to descend (note arrow in FIG. 10). The footrest extension may of course be latched in a fully raised position by sliding it upwardly until tongue 43 clears stop block 44 and the end of the tongue bears against the block in the manner previously described.

During longitudinal sliding movement of the footrest extension (whether the entire assembly 13*d* is horizontal, vertical, or some angular position in between) bearing element 34 rides along slot or channel 22 and bearing element 33 slidably engages the outwardly-facing guide surface 20*b* of the first guide rail 20. If the user wishes to pivot the footrest extension 29 into a position at generally right angles to the frame 15, the footrest extension is first slid into its fully retracted position, with bearing member 34 engaging stop means 25, and then the free distal end of the footrest extension 29 is swung away from the frame 15 as depicted in FIGS. 11 and 12. Bearing element 33, having been shifted beyond the distal limits of guide rail 20, passes through notch or recess 26 and travels along the arcuate guide surface 25*a* leading to the outwardly facing guide surface 21*b* of rail 21. Pivotal movement of the footrest extension is continued until the extension passes beyond a position at right angles to frame 15; under such circumstances, the direct spacing between bearing elements 33 and 34 exceeds the width or thickness of guide rail 21 and the footrest extension may easily be adjusted vertically into any selected position (FIG. 13). Once such a position is determined, the footrest extension is allowed to swing downwardly until it is generally perpendicular to frame 15. Where notches 23 are provided along the inwardly-facing surface 21*a* of guide rail 21, bearing element 34 is received within any one of such notches to provide positive locking action against upward and downward sliding movement of the footrest extension 29 (FIG. 14). During vertical adjustment of the footrest extension, and when that extension is locked in a selected position of adjustment, bearing element 33 engages, or is free to engage, the outwardly facing guide surface 21*b* of guide rail 21.

Should the footrest extension be oriented in the forwardly-projecting position shown in FIGS. 14 and 2 (broken lines), and should such extension engage an obstacle as the power-operated table descends, the front or distal end of the footrest extension may freely pivot upwardly into the position shown in FIG. 13, thereby avoiding damage to furniture or medical appliances that might be located in close proximity to the table, or injury to a doctor, nurse, or assistant, that might otherwise result from such contact.

The frame 15 has been shown and described as having a pair of longitudinal side walls 15*a*, each with a pair of rails 20 and 21 for guiding movement of bearing elements 33 and 34 carried by opposite side members 30 of footrest extension 29. While such an arrangement is preferred for a number of reasons (e.g., increased stability, ease of manipulation, smoothness of operation, and availability of space within the frame for other components such as power drive elements), it is possible that satisfactory results might be achieved if only a single set of rails 20 and 21 were provided for guiding only one set of bearing elements 33 and 34. The rails need not project from a side wall but might extend along some other vertical and longitudinal wall such as, for example, a wall located between and parallel with the side walls of the frame. In any case, at least one set of rails 20 and 21 must be provided for guiding bearing elements 33 and 34 so that the footrest extension may be retracted, extended, pivoted, and locked in its various positions of adjustment.

While in the foregoing we have disclosed an embodiment of the invention in considerable detail for purposes of illustration, it will be understood by those skilled in the art that many of these details may be varied without departing from the spirit and scope of the invention.

We claim:

1. A leg and foot support assembly for an adjustable table/chair having a vertical movable seat section, said assembly comprising a frame having a proximal end adapted to be hingedly connected to the seat section of a table/chair for movement between raised and lowered positions; said frame including at least one vertical and longitudinal wall having first and second longitudinally-extending guide rails defining an elongated guide channel therebetween; a footrest extension having a member extending along said wall; said member having a pair of bearing elements adjacent the proximal end of said extension; one of said bearing elements being slidably retained in said guide channel for slidable and pivotal engagement with the inwardly-facing longitudinal surfaces of said rails defining said channel and the other of said bearing elements being slidably engagable with the outwardly-facing surfaces of said guide rails; and stop means blocking said guide channel at the proximal end thereof for limiting the extent of sliding movement of said one bearing element in a proximal direction and for permitting pivotal movement of said footrest extension to shift said second bearing element from sliding engagement with the outwardly-facing surface of one of said guide rails into sliding engagement with the outwardly-facing surface of the other of said guide rails.

2. The assembly of claim 1 in which said pair of bearing elements provided by said member are spaced apart in a direction longitudinally of said member; said other bearing element being proximal to said one bearing element.

3. The assembly of claim 2 in which said other bearing element is proximal to said one bearing element a distance approximating the width of said second guide rail measured between the inwardly- and outwardly-facing surfaces thereof.

4. The assembly of claims 1, 2 or 3 in which said bearing elements provided by said member are spaced apart in a direction extending transversely of said member.

5. The assembly of claim 4 in which said transverse spacing is slightly greater than the thickness of said first guide rail measured between the inwardly- and outwardly-facing surfaces thereof.

6. The assembly of claims 1, 2 or 3 in which said bearing elements comprise rigid pegs.

7. The assembly of claim 6 in which said pegs are cylindrical in configuration.

8. The assembly of claim 7 in which the cylindrical peg constituting said one bearing element of said pair has a diameter slightly less than the width of said guide channel.

9. The assembly of claims 1, 2 or 3 in which said second guide rail is provided with a series of longitudinally-spaced notches along said channel for receiving and retaining said one bearing element.

10. The assembly of claim 1 in which said stop means has an arcuate outer surface merging smoothly with the outwardly-facing guide surface of said second guide rail and engagable with said other bearing element for guiding the same towards and away from said outwardly-facing surface of said second guide rail when said footrest extension is pivoted while said one bearing element is located at the proximal end of said guide channel.

11. The assembly of claim 1 in which said footrest extension has a distal end; and stop means at the distal end of said channel for engaging said one bearing element and retaining the same within said channel.

12. The assembly of claim 1 in which said footrest extension and said frame are provided with a latching member and stop member engagable with each other to block coplanar sliding movement of said extension with respect to said frame when said one bearing element is disposed at the proximal end of said guide channel.

13. A leg and foot support assembly for an adjustable table/chair having a vertically movable seat section, said assembly comprising a frame having a proximal end adapted to be hingedly connected to the seat section of a table/chair for movement between raised and lowered positions; said frame including a pair of side walls each having first and second longitudinally-extending guide rails defining an elongated guide channel therebetween; a footrest extension having a pair of elongated side members extending along the side walls of said frame and having a support panel interconnecting said side members; each side member having a pair of bearing elements adjacent the proximal end thereof; one of said bearing elements being slidably retained in said guide channel for slidable and pivotal engagement with the inwardly-facing longitudinal surfaces of said rails defining said channel; the other of said pair of bearing elements being slidably engagable with the outwardly-facing surfaces of said guide rails; and stop means blocking said guide channel at the proximal end thereof for limiting the extent of sliding movement of said one bearing element in a proximal direction and for permitting pivotal movement of said footrest extension to shift said second bearing element from sliding engagement with the outwardly-facing surface of one of said guide rails into sliding engagement with the outwardly-facing surface of the other of said guide rails.

14. The assembly of claim 13 in which said pair of bearing elements provided by each side member are spaced apart in a direction longitudinally of said member; said other bearing element being proximal to said one bearing element.

15. The assembly of claim 14 in which said other bearing element is proximal to said one bearing element a distance approximating the width of said second guide rail measured between the inwardly- and outwardly-facing surfaces thereof.

16. The assembly of claims 13, 14, or 15 in which said bearing elements provided by each elongated side member are spaced apart in a direction extending transversely of said member; said other bearing element being closer to the plane of said connecting support panel than said one bearing element.

17. The assembly of claim 16 in which said transverse spacing is slightly greater than the thickness of said first guide rail measured between the inwardly- and outwardly-facing surfaces thereof.

18. The assembly of claim 13 in which said bearing elements comprise rigid pegs.

19. The assembly of claim 18 in which said pegs are cylindrical in configuration.

20. The assembly of claim 19 in which the cylindrical peg constituting said one bearing element of each pair has a diameter slightly less than the width of said guide channel.

21. The assembly of claim 13 in which said second guide rail is provided with a series of longitudinally-spaced notches along said channel for receiving and retaining said one bearing element.

22. The assembly of claim 13 in which said stop means has an arcuate outer surface merging smoothly with the outwardly-facing guide surface of said second guide rail and engagable with said other bearing element for guiding the same towards and away from said outwardly-facing surface of said second guide rail when said footrest extension is pivoted while said one bearing element is located at the proximal end of said guide channel.

23. The assembly of claim 13 in which said footrest extension has a distal end; and stop means at the distal end of said channel for engaging said one bearing element and retaining the same within said channel.

24. The assembly of claim 13 in which said footrest extension and said frame are provided with a latching member and stop member engagable with each other to block coplanar sliding movement of said extension with respect to said frame when said one bearing element is disposed at the proximal end of said guide channel.

25. An adjustable table/chair having a vertically extendable and retractable base, a seat section supported by said base, and a back section hingedly connected to said seat section; wherein the improvement comprises a leg and foot support assembly comprising a frame having a proximal end hingedly connected to said seat section for pivotal movement between a generally horizontal raised position and a generally vertical lowered position; said frame including a pair of parallel side walls; a footrest extension having a pair of elongated side members extending along said side walls in close proximity thereto and having a planar support panel connecting said members to each other;

each of said side walls having first and second longitudinal guide rails defining an elongated guide slot therebetween; each side member of said footrest extension having a pair of bearing elements adjacent the proximal end thereof;

one of said bearing elements being slidably retained in said guide slot for slidable and pivotal engagement with the inwardly-facing longitudinal surfaces of said rails defining said slot; the other of said pair of bearing elements being slidably engagable with the outwardly-facing surfaces of said guide rails;

and stop means at the proximal end of said guide slot for limiting sliding movement of said one bearing element in a proximal direction and for permitting pivotal movement of said footrest extension to shift said second bearing element from sliding engagement with the outwardly-facing surface of one of said guide rails into sliding engagement with the outwardly-facing surface of the other of said guide rails.

26. The table/chair of claim 25 in which said pair of bearing elements provided by each side member are spaced apart in a direction longitudinally of said member; said other bearing element being proximal to said one bearing element.

27. The table/chair of claim 26 in which said other bearing element is proximal to said one bearing element a distance approximating the width of said second guide rail measured between the inwardly- and outwardly-facing surfaces thereof.

28. The table/chair of claim 25 in which said bearing elements provided by each elongated side member are spaced apart in a direction extending transversely of said member; said other bearing element being closer to the plane of said connecting support panel than said one bearing element.

29. The table/chair of claim 28 in which said transverse spacing is slightly greater than the thickness of said first guide rail measured between the inwardly- and outwardly-facing surfaces thereof.

30. The table/chair of claim 25 in which said bearing elements are rigid.

31. The table/chair of claim 30 in which said rigid bearing elements are cylindrical in configuration.

32. The table/chair of claim 31 in which the cylindrical bearing element constituting said one element of each pair has a diameter slightly less than the maximum width of said guide slot.

33. The table/chair of claim 32 in which said second guide rail is provided with a series of longitudinally-spaced notches along said slot for receiving and retaining said one bearing element; said maximum width of said guide slot being measured at the location of one of said notches.

34. The table/chair of claim 25 in which said stop means has an arcuate outer surface merging smoothly with the outwardly-facing surface of said second guide rail and engagable with said other bearing element for guiding the same towards and away from said outwardly-facing surface of said second guide rail when said footrest extension is pivoted while said one bearing element is located at the proximal end of said guide slot.

35. The table/chair of claim 25 in which said footrest extension has a distal end; and stop means at the distal end of each of said slots for engaging said one bearing element and retaining the same within said slot.

* * * * *